US009927201B2

(12) United States Patent
Penchuk

(10) Patent No.: US 9,927,201 B2
(45) Date of Patent: Mar. 27, 2018

(54) BARREL COUPLING FOR FIREARM

(71) Applicant: Alexander Nikolaevich Penchuk, Kremenchug (RU)

(72) Inventor: Alexander Nikolaevich Penchuk, Kremenchug (RU)

( * ) Notice: Subject to any disclaimer, the term of this patent is extended or adjusted under 35 U.S.C. 154(b) by 305 days.

(21) Appl. No.: 14/739,036

(22) Filed: Jun. 15, 2015

(65) Prior Publication Data

US 2016/0097609 A1 Apr. 7, 2016

(30) Foreign Application Priority Data

Oct. 3, 2014 (UA) ..... A201410797
Nov. 10, 2014 (RU) ..... 201445192

(51) Int. Cl.
*F41A 21/32* (2006.01)

(52) U.S. Cl.
CPC ..... *F41A 21/325* (2013.01)

(58) Field of Classification Search
CPC ..... F41A 21/00; F41A 21/325; F41A 21/48; F41A 21/32; F41A 21/482; F41A 3/30; F41A 11/02; F41A 21/481; F41A 21/485; F41A 21/487; F41A 21/488; F42B 5/025; F42B 30/02; F42B 12/00; F42B 5/035; F42B 5/26; F42B 5/32; F42B 8/04; F42B 12/34; F42B 12/46; F42B 35/00; F42B 5/30; F42B 7/04; F42B 7/06; F42B 7/08; F42B 8/10; F42B 10/28; F42B 10/36; F42B 12/02; F42B 12/36; F42B 14/02; F42B 15/00; F42B 15/10; F42B 5/03; F42B 5/145; F42B 5/18; F42B 5/184; F42B 7/02; F41B 11/00; F41C 7/11
USPC ..... 42/77; 89/14.2–14.4
See application file for complete search history.

(56) References Cited

U.S. PATENT DOCUMENTS 1,517,328 A * 12/1924 Weiss ..... F41A 21/10 42/77
1,661,949 A * 3/1928 Krenek ..... F41A 21/485 42/75.02
2,315,207 A * 3/1943 Janecek ..... F41A 21/46 102/518
2,466,400 A * 4/1949 Ennis ..... F41A 21/40 42/79
2,503,491 A * 4/1950 Janz ..... F41A 21/30 181/223
2,589,738 A * 3/1952 Sedberry ..... F41A 21/42 42/79
2,696,995 A * 12/1954 Schacht ..... F41A 21/325 285/392

(Continued)

*Primary Examiner* — Michelle R Clement
*Assistant Examiner* — Bridget Cochran
(74) *Attorney, Agent, or Firm* — Nadya Reingand; Yan Hankin

(57) ABSTRACT

The invention relates to the firearm hardware, namely to barrel coupling for firearm. Due to the new muzzle adapter construction, clamping mechanism, which consists of a separator with cams and a clamping sleeve, it makes it possible to mount muzzle accessories to the barrels without any special preparation. The separator is manufactured as a casing with a plurality of cam sockets and a plurality of elongated L-shaped cams insertable into the said sockets with the longer part of the cam shaped to match the socket. The new barrel coupling is more reliable and more durable, it is comfortable and easy to install and remove.

9 Claims, 17 Drawing Sheets

(56) References Cited

U.S. PATENT DOCUMENTS 2,829,742 A * 4/1958 Wallace ..... F16B 5/04 102/464
2,922,242 A * 1/1960 Pachmayr ..... F41A 21/40 42/79
3,238,657 A * 3/1966 Foote ..... F41A 21/12 42/76.01
3,690,026 A * 9/1972 Rose ..... F41C 27/06 102/512
3,714,864 A * 2/1973 Thierry ..... F41A 21/38 89/14.3
3,805,434 A * 4/1974 Sudano ..... F41A 21/10 42/77
3,842,527 A * 10/1974 Low ..... F41A 21/482 42/75.02
3,867,778 A * 2/1975 Preda ..... F41A 21/40 42/79
4,510,843 A * 4/1985 Rabatin ..... F41A 21/325 89/14.4
4,542,606 A * 9/1985 Hoenig ..... F41A 21/487 42/75.02
4,644,930 A * 2/1987 Mainhardt ..... F41A 11/02 124/58
4,685,235 A * 8/1987 Bunning ..... F41A 21/484 42/75.02
4,707,942 A * 11/1987 Peters ..... F41A 21/487 42/77
4,893,426 A * 1/1990 Bixler ..... F16B 7/20 403/299
4,989,359 A * 2/1991 Kinkner ..... F41A 21/06 42/77
5,188,398 A * 2/1993 Parimore, Jr. ..... F16L 19/005 285/330
5,325,617 A * 7/1994 Vojta ..... F41A 11/02 42/75.03
5,559,302 A * 9/1996 Latka ..... F41A 21/325 89/14.05
5,729,927 A * 3/1998 Shaver, Jr. ..... F42B 8/10 42/77
5,758,445 A * 6/1998 Casull ..... F41A 15/12 42/25
5,773,746 A * 6/1998 Vaden ..... F41A 21/325 181/223
5,851,035 A * 12/1998 Marc ..... F16L 19/005 285/86
6,295,752 B1 * 10/2001 Havlock ..... F41A 21/00 124/71
6,385,891 B1 * 5/2002 Rabatin ..... F41A 21/30 42/77
6,513,274 B1 * 2/2003 Vastag ..... F41A 11/02 42/135
6,698,128 B2 * 3/2004 Kessler ..... F41A 21/00 124/83
6,718,677 B2 * 4/2004 Camp ..... F41C 9/08 29/256
7,661,349 B1 * 2/2010 Brittingham ..... F41A 21/30 181/223
7,676,976 B2 * 3/2010 Dueck ..... F41A 21/30 42/90
7,743,693 B1 * 6/2010 Brittingham ..... F41A 21/325 89/14.2
7,775,200 B2 * 8/2010 Anderson ..... F41B 11/00 124/83
7,891,282 B1 * 2/2011 DeGroat ..... F41A 21/325 181/223
8,091,462 B2 * 1/2012 Dueck ..... F41A 21/325 42/76.01
8,281,698 B2 * 10/2012 Haywood ..... F41A 21/482 42/75.01
8,424,441 B2 * 4/2013 Brittingham ..... F41A 21/30 181/223
8,671,818 B1 * 3/2014 Oliver ..... F41A 21/28 181/223
8,763,510 B2 * 7/2014 Dueck ..... F41A 21/26 89/14.4
8,973,481 B2 * 3/2015 Dueck ..... F41A 21/325 181/223
8,997,621 B1 * 4/2015 Dater ..... F41A 21/325 89/14.3
9,099,807 B2 * 8/2015 Opgenorth ..... H01R 13/622
9,121,656 B1 * 9/2015 McKenzie ..... F41A 21/325
9,328,582 B2 * 5/2016 Trevino ..... E21B 33/0422
9,739,560 B1 * 8/2017 Salvador ..... F41A 21/325
2009/0133310 A1 * 5/2009 Wossner ..... F41A 17/44 42/77
2011/0197487 A1 * 8/2011 Humston ..... F41A 21/34 42/1.06
2012/0180623 A1 * 7/2012 Graham, II ..... F41A 21/325 89/14.4
2014/0007481 A1 * 1/2014 Tresserras Torre ..... F41A 21/02 42/76.1
2014/0020976 A1 * 1/2014 Shults ..... F41A 21/30 181/223
2014/0075818 A1 * 3/2014 Piontek ..... F41A 21/10 42/77
2014/0237881 A1 * 8/2014 Mack ..... F41A 21/325 42/90
2015/0168092 A1 * 6/2015 Stone ..... F41A 21/28 42/76.01
2015/0184960 A1 * 7/2015 Monveldt ..... F41A 5/26 89/193
2015/0198403 A1 * 7/2015 Bentley ..... F41A 21/484 42/75.02
2015/0260472 A1 * 9/2015 Smith ..... F41A 21/30 89/14.2
2016/0033226 A1 * 2/2016 Potter ..... F41A 3/30 42/76.01
2016/0076844 A1 * 3/2016 Miller, III ..... F41A 21/30 89/14.3
2016/0102935 A1 * 4/2016 Young ..... F41A 21/325 42/76.01

* cited by examiner

6

BARREL COUPLING FOR FIREARM

CROSS-REFERENCE TO RELATED APPLICATIONS

This application is a non-provisional application 3 which claims priority to Ukrainian application a201410797 filed on Oct. 3, 2014 and Russian application RU201445192 filed on Nov. 10, 2014 currently allowed.

FIELD OF INVENTION

The invention relates to the firearm hardware, namely to barrel coupling for firearm.

BACKGROUND

Known barrel coupling, "3-lug adapter" ("Soldier of Fortune", N° 6 1997, p. 26-30) for weapons is mounted to the barrel using three salient chuck jaws on the barrel.

Thread is usually used for mounting muzzle accessories to firearms barrel like guns and carabines (Device for silent and flameless shooting of 7.62-mm modernized Kalashnikov. Service manual, Voenizdat USSR Ministry of Defense. M. 1972)

Inability to mount the muzzle accessory to a properly unprepared gun barrel is the disadvantage of all the above mentioned kinds of barrel coupling for firearms.

In addition, there are difficulties with the barrel preparation for installing the muzzle accessory. Barrel loses its original factory form, which is not always acceptable.

The closest to the claimed solution is the barrel coupling to firearms, which includes the muzzle adapter to the barrel, separator with balls and clamping sleeve (Knight's Armament Airsoft 556 QDC/CQB Quick Detach Suppressor (14 mm CCW, BK)

In order to mount the mentioned above barrel coupling to firearm, the barrel has to be specially prepared, namely, special sockets have to be made for the balls or special adapter with sockets for the balls has to be installed on a thread.

SUMMARY

The invention objective is to improve the barrel coupling to firearms. Due to the new muzzle adapter construction, clamping mechanism, which consists of a separator with cams and a clamping sleeve, it makes it possible to mount muzzle accessories to the barrels without any special preparation. At the same time, the new adapter is more reliable and enduring, besides, it can be easily installed and removed.

The problem is solved by proposed barrel coupling for firearms comprising muzzle adapter and clamping mechanism, in which, according to the invention, the muzzle adapter includes a main casing, on the internal surface of which there are at least one threaded region and a wall featuring an orifice for the bullet, whereby a circular belt exists in between the said wall with a bullet orifice and the said threaded internal surface region, said belt being partially splayed one-way using an eccentric grooving; the clamping mechanism consists of a separator and a sleeve, whereby the separator comprises a casing with a plurality of cam sockets and a plurality of elongated L-shaped cams insertable in the sockets with the longer part of the cam shaped to match the socket whereby the internal surface of the longer part of the cam has notches; the casing end touches the above-mentioned wall with the bullet orifice and has a salient circular belt on the external diameter; the clamping mechanism's sleeve comprises a cylindrical casing with an internal surface of frustoconical shape and an external surface with threading.

Besides, inside the barrel coupling for firearms there is the wall with a bullet orifice, located within the adapter main casing and the wall divides its internal space into two parts, wherein a casing part with internal thread and circular belt are located adjacent to the barrel end, and internal or external threaded region is located adjacent to the muzzle accessory.

Besides, the wall with bullet orifice is located at the end of the adapter main casing, adjacent to a muzzle accessory.

Barrel coupling, according to the invention, has the main casing with at least one threaded region on the internal surface and has a wall with bullet orifice whereby a circular belt exists in between the said wall with a bullet orifice and the said threaded internal surface, said belt is partly splayed one-way using an eccentric grooving, wherein the casing part with the internal thread and the circular belt are located adjacent to the barrel end, and internal or external threaded region is located adjacent to the muzzle accessory.

Besides, the wall with a bullet orifice is located within the main casing of the adapter and divides the internal space into two parts.

Besides, the wall with a bullet orifice is located at the main casing end, adjacent to a muzzle accessory.

Besides, on the external surface of the main casing there are additional edges for the spanner.

The separator of the clamping mechanism is characterized in that it is manufactured as a casing with a plurality of cam sockets and a plurality of elongated L-shaped cams insertable into the said sockets with the longer part of the cam shaped to match the socket, whereby the internal surface of the longer part of the cam has notches, the casing end touches the above-mentioned wall with the bullet orifice and has a salient circular belt on the external diameter.

Besides, the separator has at least two sockets for the cams.

The clamping mechanism sleeve consists of a cylindrical casing with internal surface of frustoconical shape and the external surface with threading.

Besides, the sleeve has at least one milled groove for interaction with the firearms sighting device at one of the ends.

Besides, there are additional edges for the spanner on the unthreaded external surface of the sleeve casing.

Besides, there is a flange for coupling with the one of the muzzle accessories parts at one of the ends of the sleeve casing.

Secure and strong clamping of the barrel of firearm is ensured due to the offered construction of the barrel coupling for firearms, namely due to the special design of the separator with cams and the clamping sleeve, the internal surface which has frustoconical shape, and the knurling on the internal cams surface.

BRIEF DESCRIPTION OF THE DRAWINGS

—FIG. 30 is an expanded view of FIG. 25, FIG. 31 is an expanded view of FIG. 26, FIG. 32 is an expanded view of FIG. 27, FIG. 33 is an expanded view of FIG. 28.

DETAILED DESCRIPTION OF THE INVENTION

Figure 1:
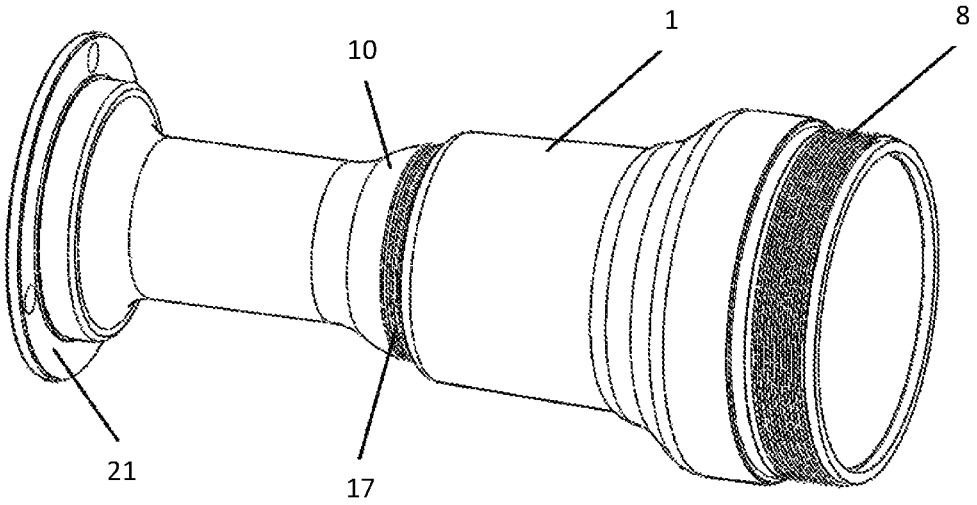
FIG. 1—barrel coupling for firearms, the general appearance of the version, with the internal space of the adapter main casing divided by the wall with the orifice, and the sleeve and the flange.
Figure 2:
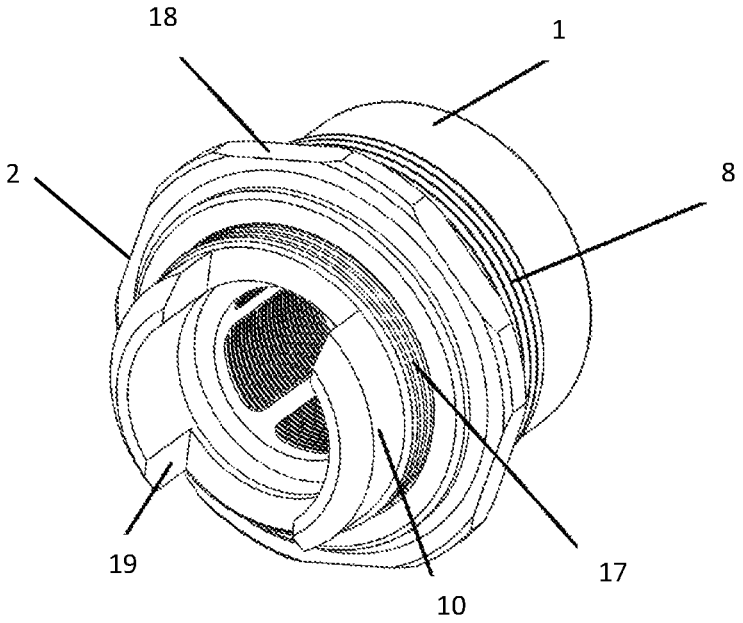
FIG. 2—barrel coupling for firearms, the general appearance of the version with the wall with the orifice at the end of the adapter main casing, and adjacent coupling to the muzzle accessory, the sleeve and the milled groove.
Figure 3:
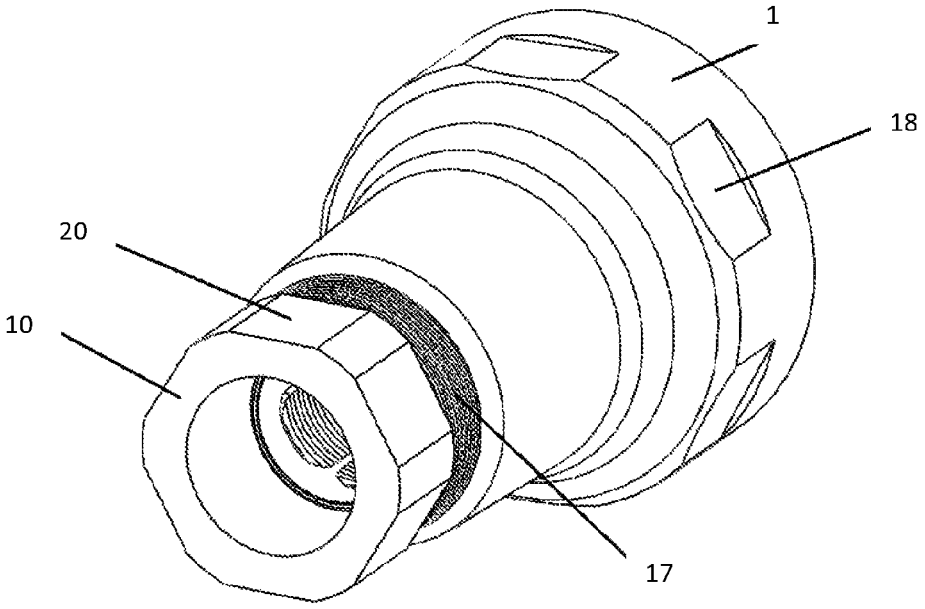
FIG. 3—barrel coupling for firearms, the general appearance of the version with the division of the internal space of the adapter main casing with the wall with the orifice and the sleeve, and edges for the spanner.
Figure 4:
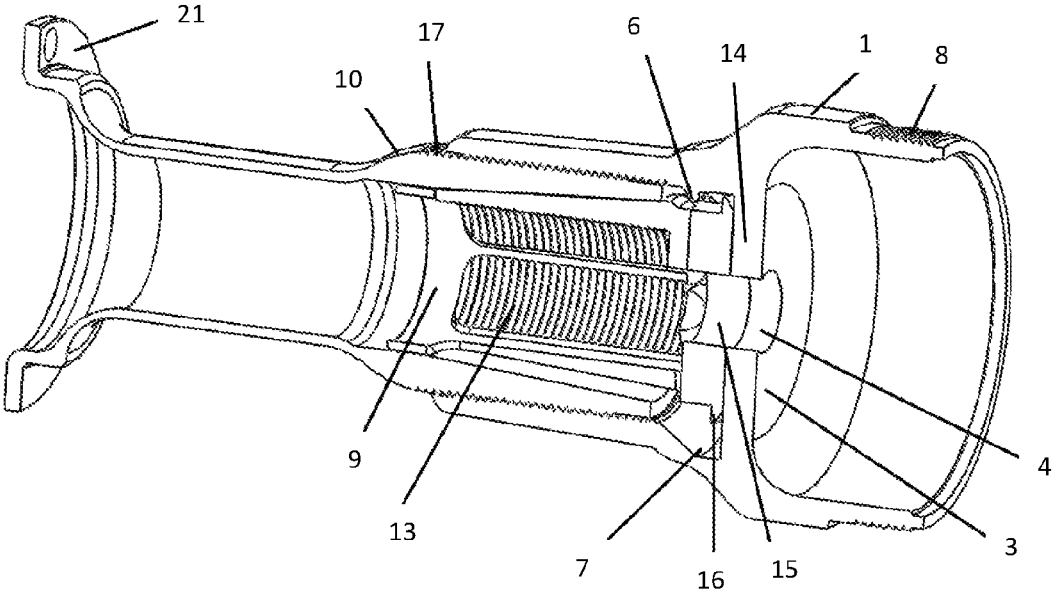
FIG. 4—barrel coupling for firearms, with the division of the internal space of the adapter main casing with the orifice and the sleeve and the flange, in section.
Figure 5:
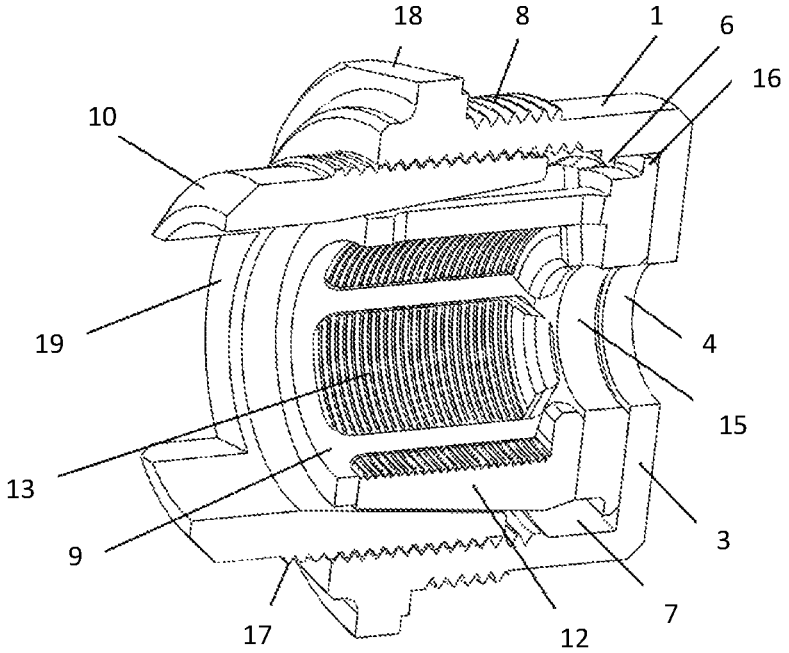
FIG. 5—barrel coupling for firearms, the general appearance of the version with the wall with the orifice located at the end of the adapter main casing, with adjacent coupling to the muzzle accessory, the sleeve and the milled groove, in section.
Figure 6:
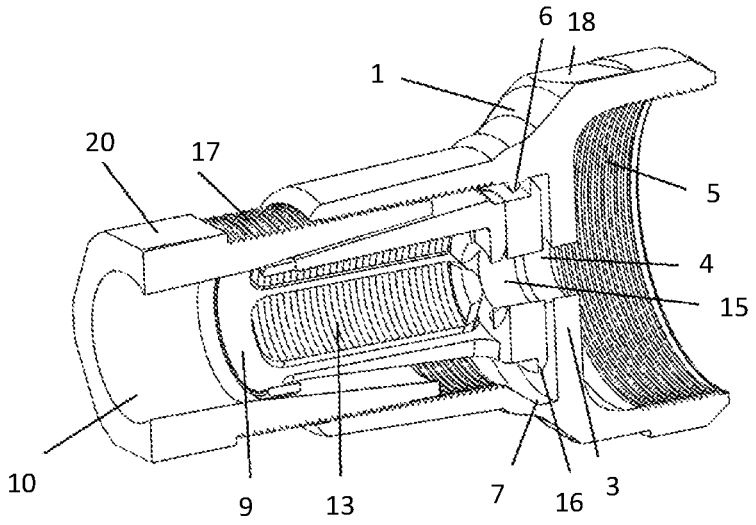
FIG. 6—barrel coupling for firearms, the version with the division of the internal, space of the adapter main casing with the wall with the orifice and the sleeve, and edges for the spanner, in section.
Figure 7:
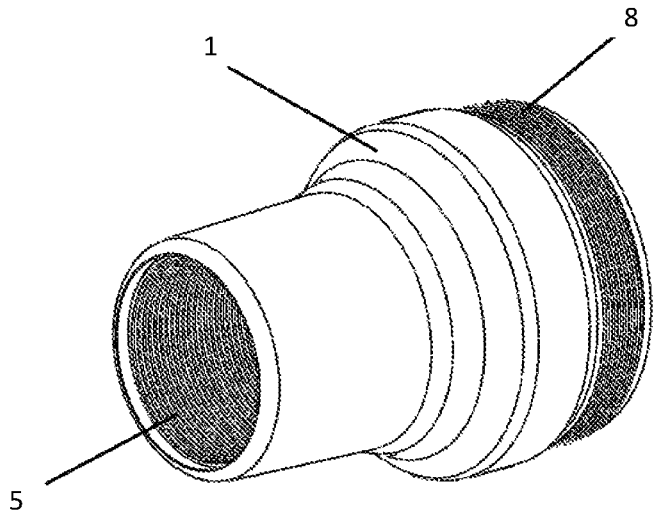
FIG. 7—view of the barrel coupling for firearms with the division of the internal space with the wall with the orifice.
Figure 8:
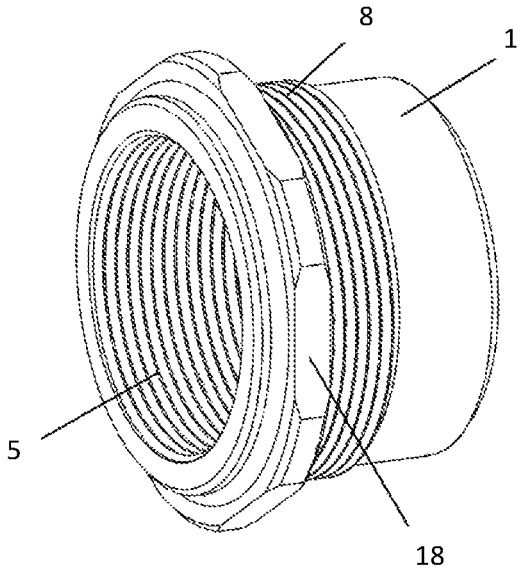
FIG. 8—view of the adapter main casing of the bane coupling for the firearms, with the wall with the orifice located at the end, and adjacent coupling to the muzzle accessory.
Figure 9:
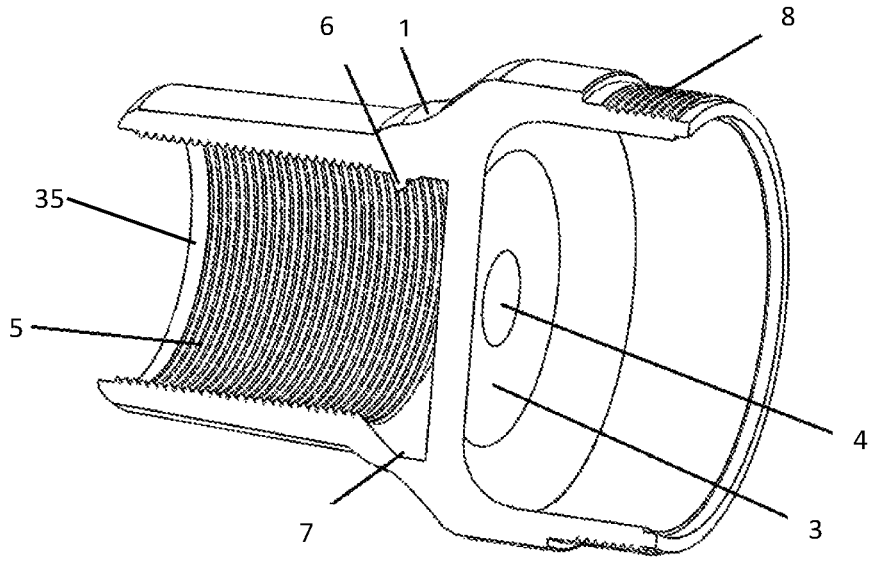
FIG. 9—view of the barrel coupling adapter for firearms with the division of the main casing internal space with the wall with the orifice, in section.
Figure 10:
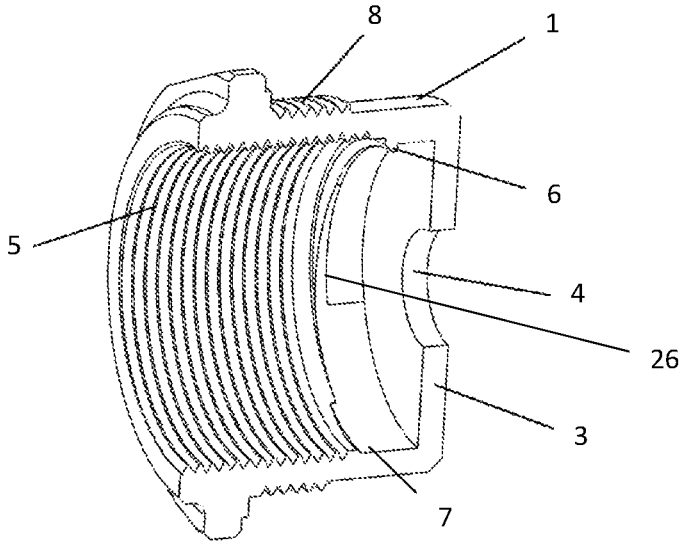
FIG. 10—view of the barrel coupling for firearms with the wall with the orifice at the end of the adapter main casing, and adjacent coupling to the muzzle accessory, in section.
Figure 11:
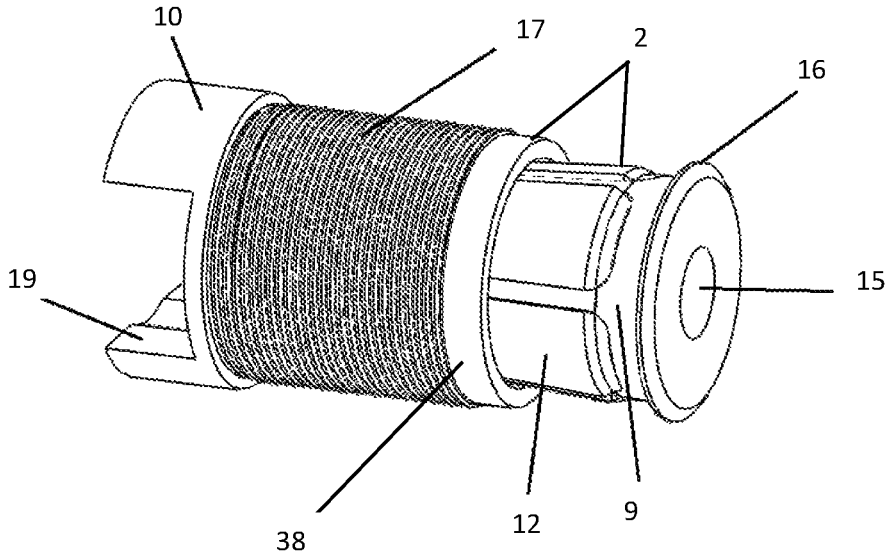
FIG. 11—view of the separator main casing with cams.
Figure 12:
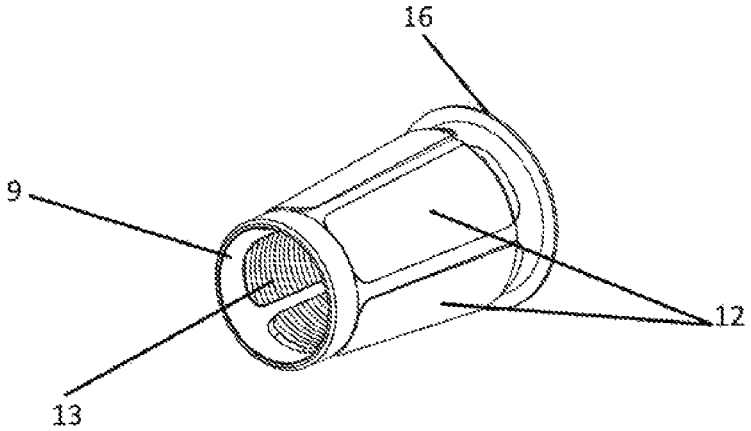
FIG. 12—view of the separator main casing with cams.
Figure 13:
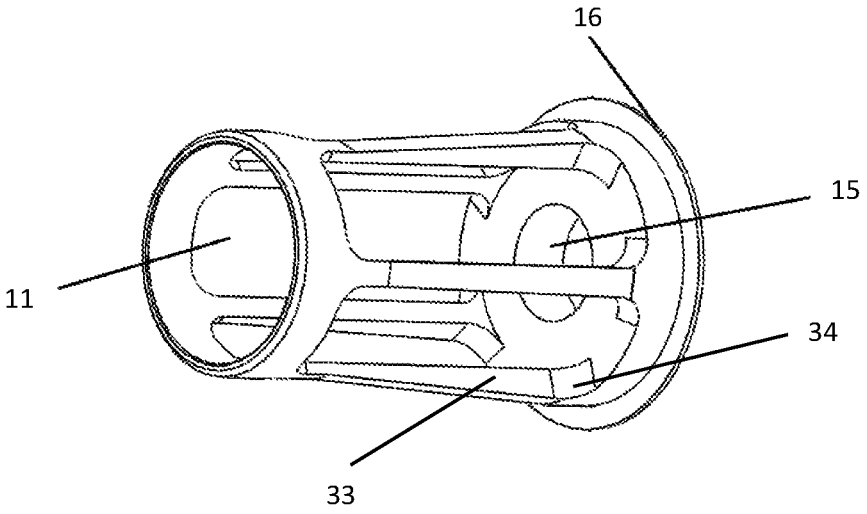
FIG. 13—general view of the separator without cams.
Figure 14:
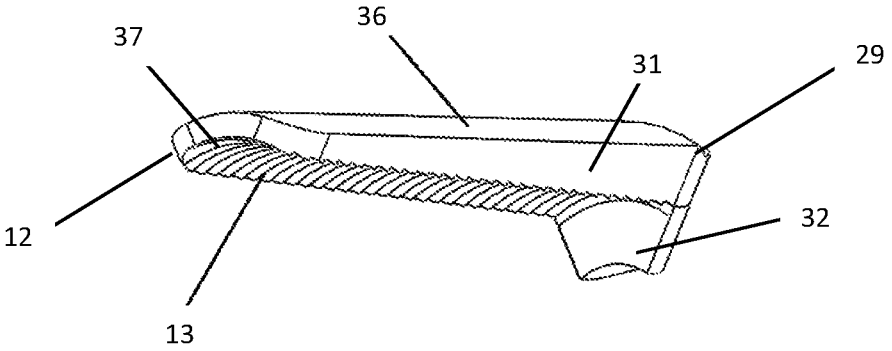
FIG. 14—perspective side view of the cam.
Figure 15:
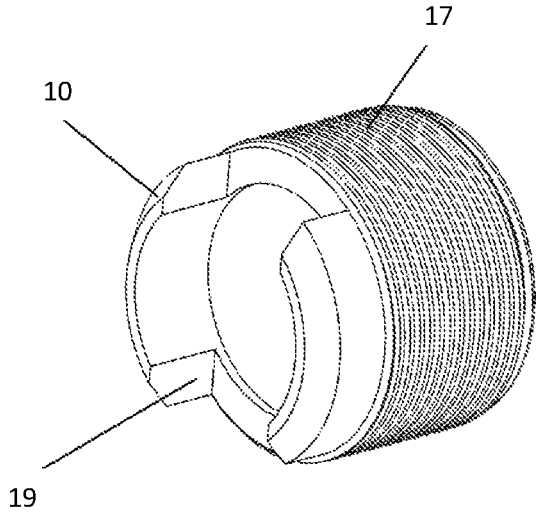
FIG. 15—view of the sleeve with the milled groove.
Figure 16:
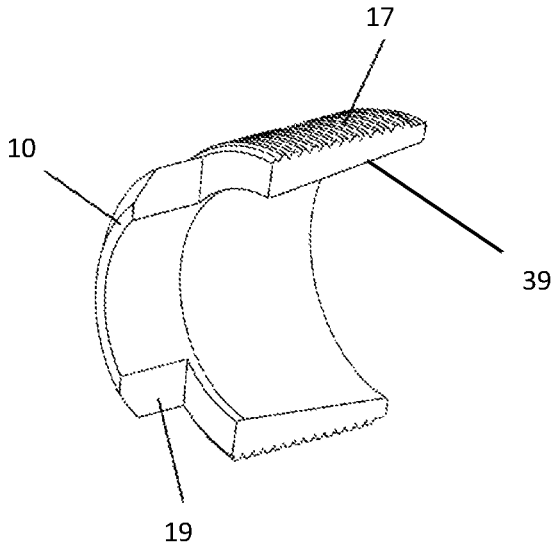
FIG. 16—a view of the sleeve with the milled groove, in section.
Figure 17:
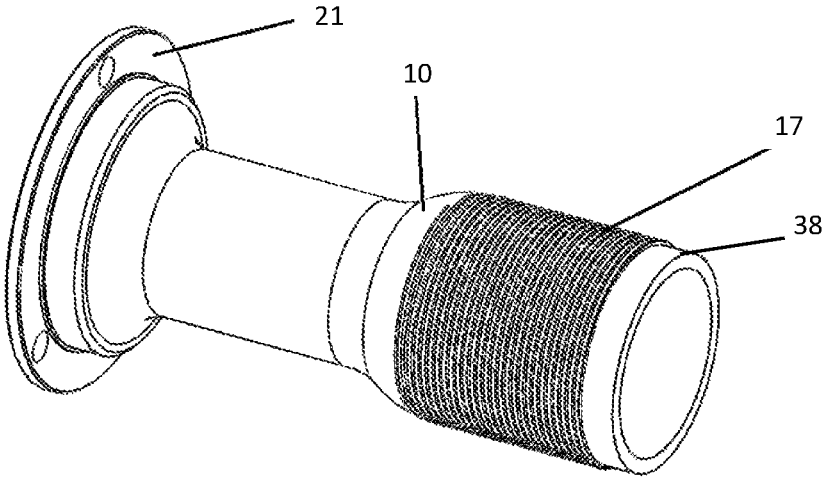
FIG. 17—view of the sleeve with the flange.
Figure 18:
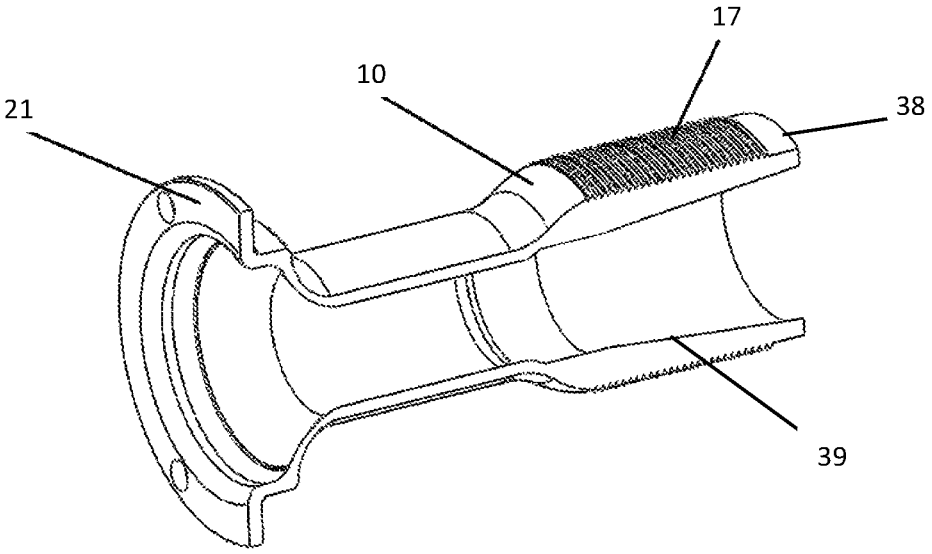
FIG. 18—view of the sleeve with the flange, in section.
Figure 19:
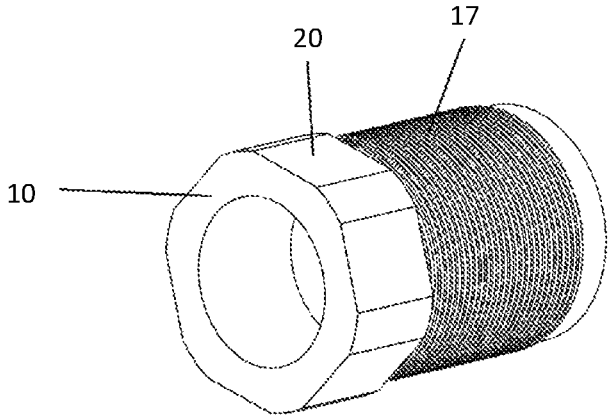
FIG. 19—view of the sleeve with edges for the spanner.
Figure 20:
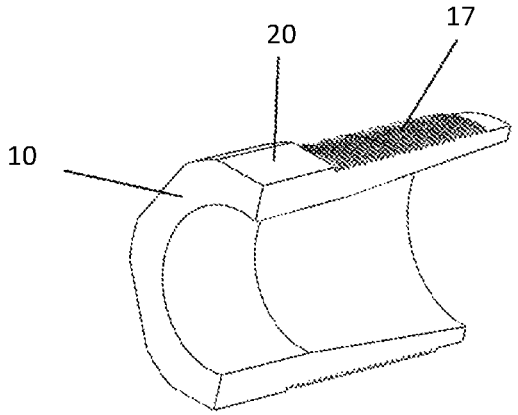
FIG. 20—view of the sleeve with edges for the spanner, in section.
Figure 21:
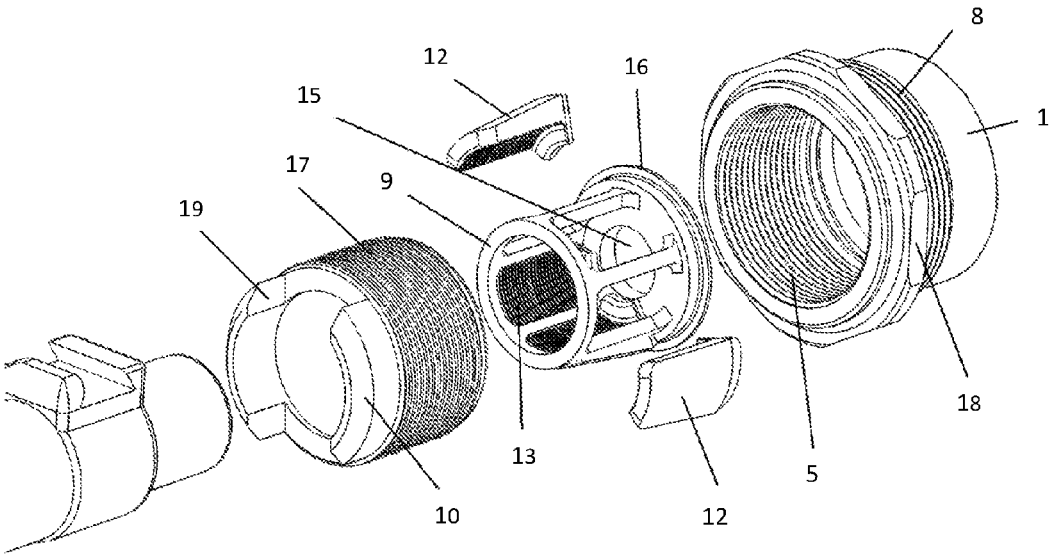
FIG. 21—exploded-view of barrel coupling for firearms with the internal space of the adapter main casing divided by the wall with the orifice, and the sleeve and the flange.
Figure 22:
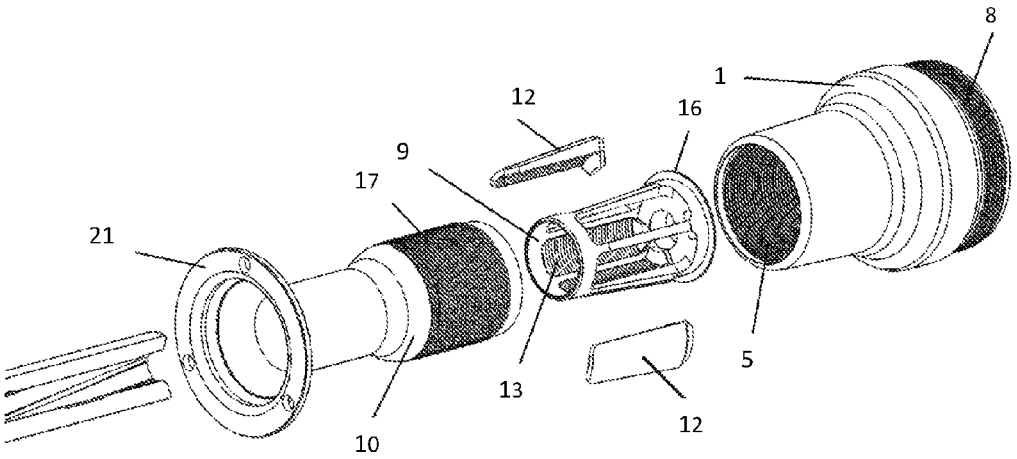
FIG. 22—exploded-view of barrel coupling for firearms with the wall with the orifice at the end of the adapter main casing, and adjacent coupling to the muzzle accessory, the sleeve and the milled groove.
Figure 23:
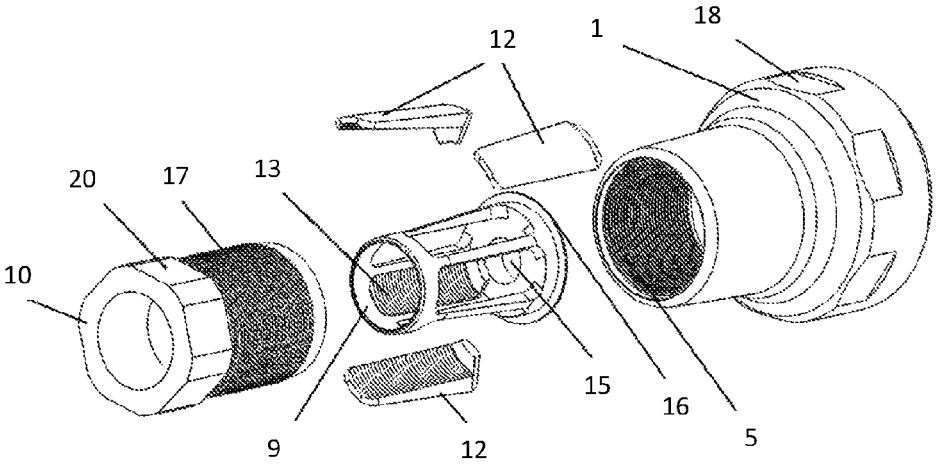
FIG. 23—exploded-view of barrel coupling for firearms with the division of the internal space of the adapter main casing with the wall with the orifice and the sleeve, and edges for the spanner.
Figure 24:
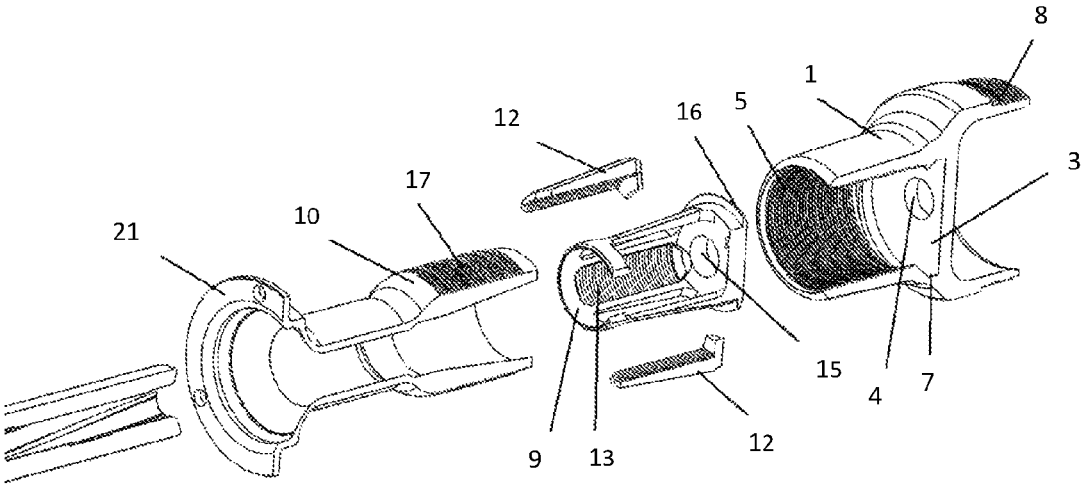
FIG. 24—exploded view of a barrel coupling for firearms with the division of the internal space of the adapter main casing with the orifice and the sleeve and the flange.
Figure 25:
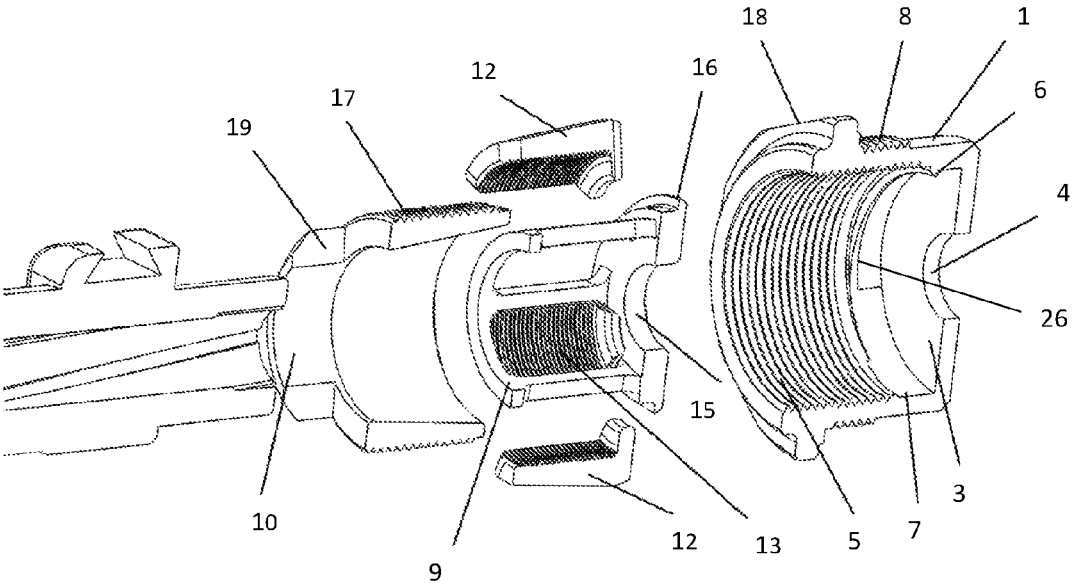
FIG. 25—exploded view of a barrel coupling for firearms with the wall with the orifice located at the end of the adapter main casing, with adjacent coupling to the muzzle accessory, and the sleeve and the milled groove.
Figure 26:
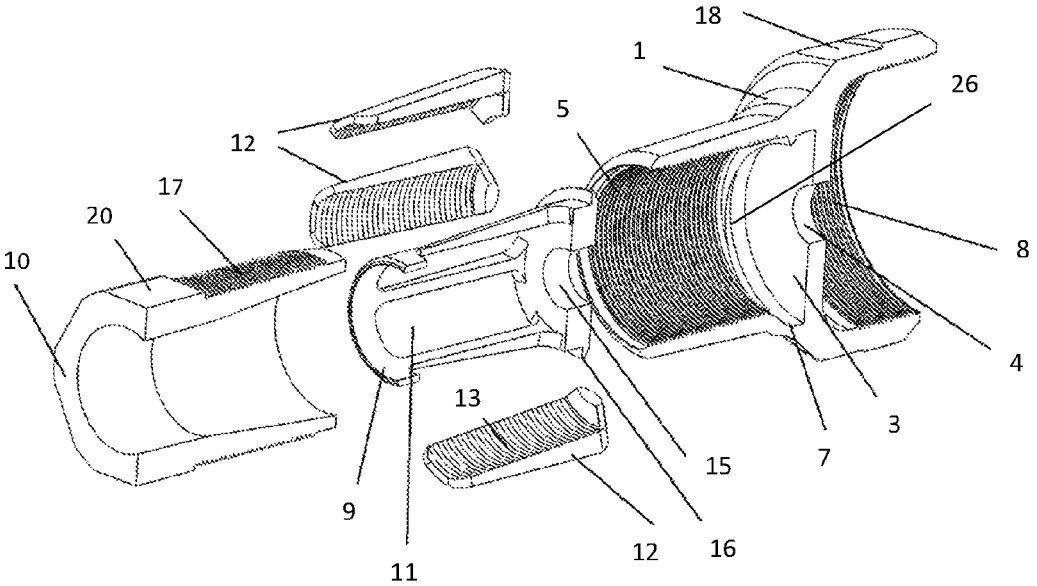
FIG. 26—exploded view of a barrel coupling for firearms, the division of the internal space of the adapter main casing with the wall with the orifice and the sleeve, and edges for the spanner.
Figure 27:
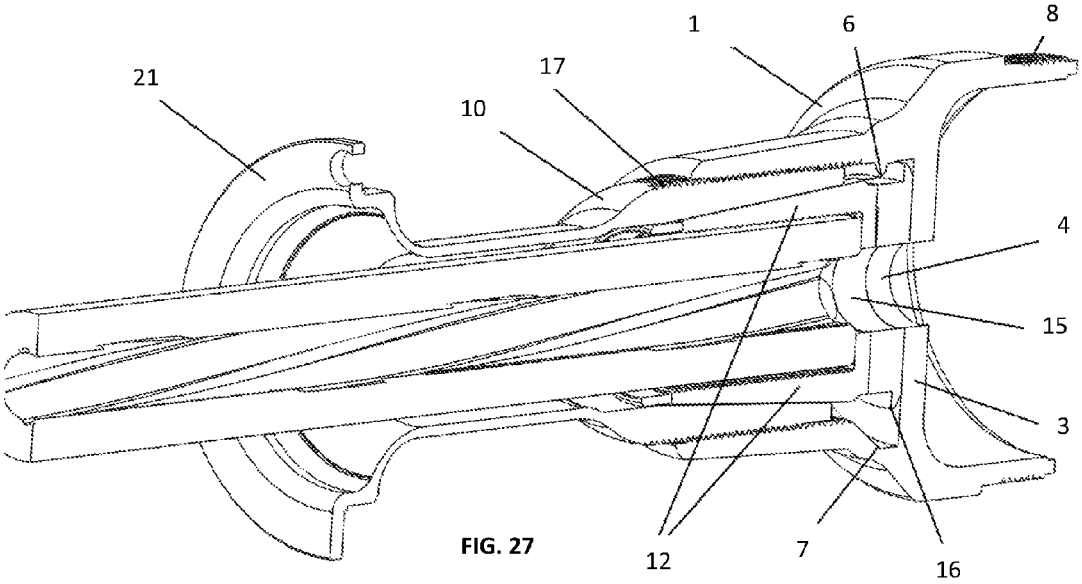
FIG. 27—section view of the barrel coupling for firearms, mounted onto the barrel of the weapon in the version with internal space of the adapter main casing divided by the wall with the orifice, and the sleeve and the flange.
Figure 28:
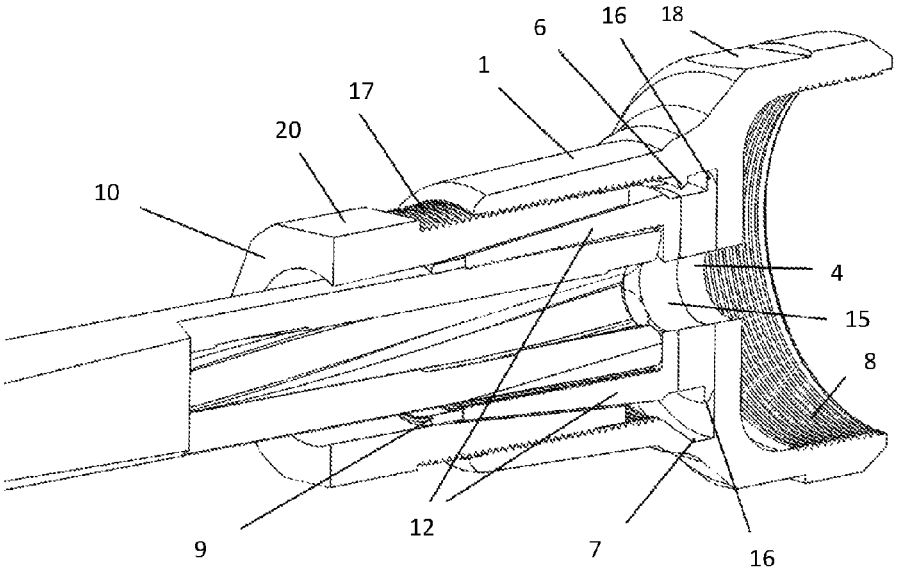
FIG. 28—sectional view of the barrel coupling to fire arms mounted on the barrel of die gun in the version with the division of the internal space of the adapter main casing with the wall with the orifice and the sleeve, and edges for the spanner.
Figure 29:
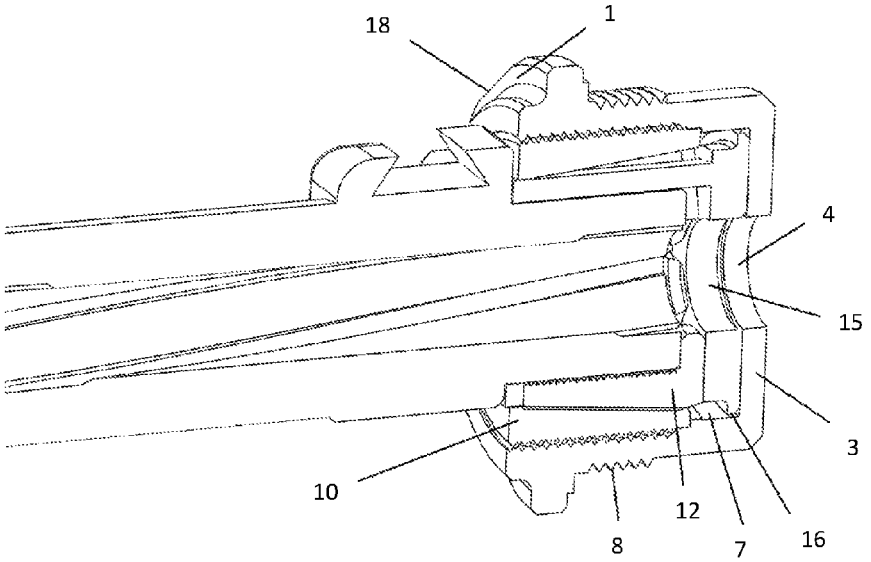
FIG. 29—sectional view of the barrel coupling to fire arms mounted on the barrel of the gun in the version with the orifice at the end of the adapter main casing, and adjacent coupling to the muzzle accessory, the sleeve and the milled groove.
Figure 30:
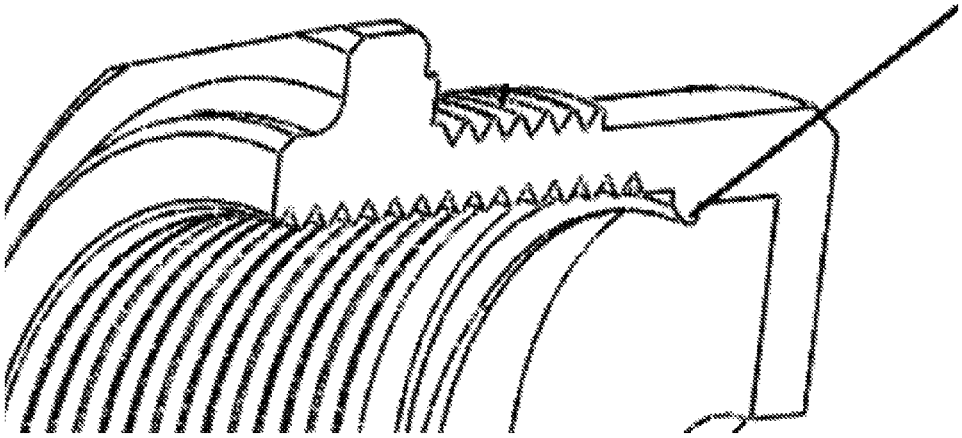
FIGS. 30-33 are expanded views of FIGS. 25-28, detailing examples of the partially splayed annular shoulder and the salient circular belt of the present invention
Figure 31:
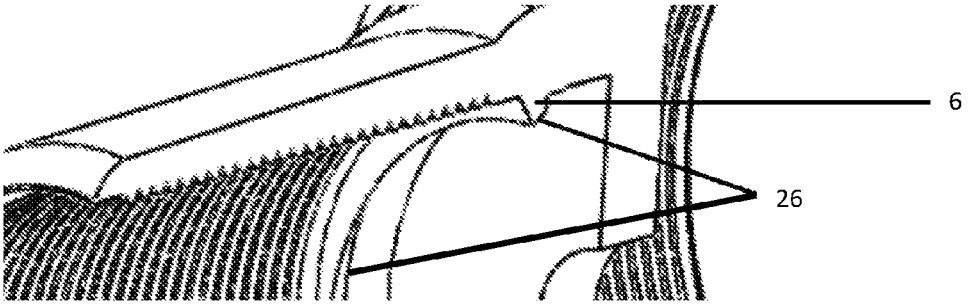
Figure 32:
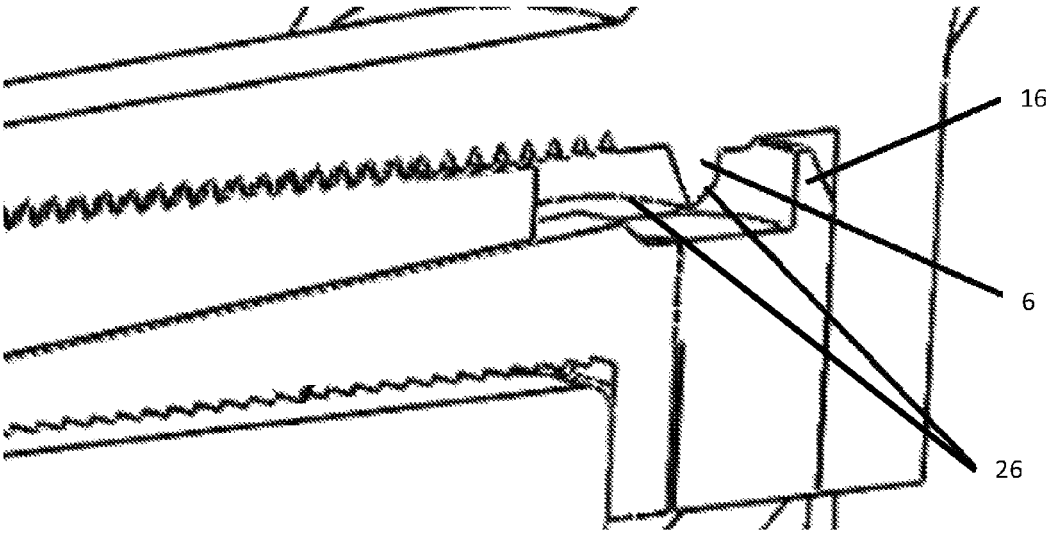
Figure 33:
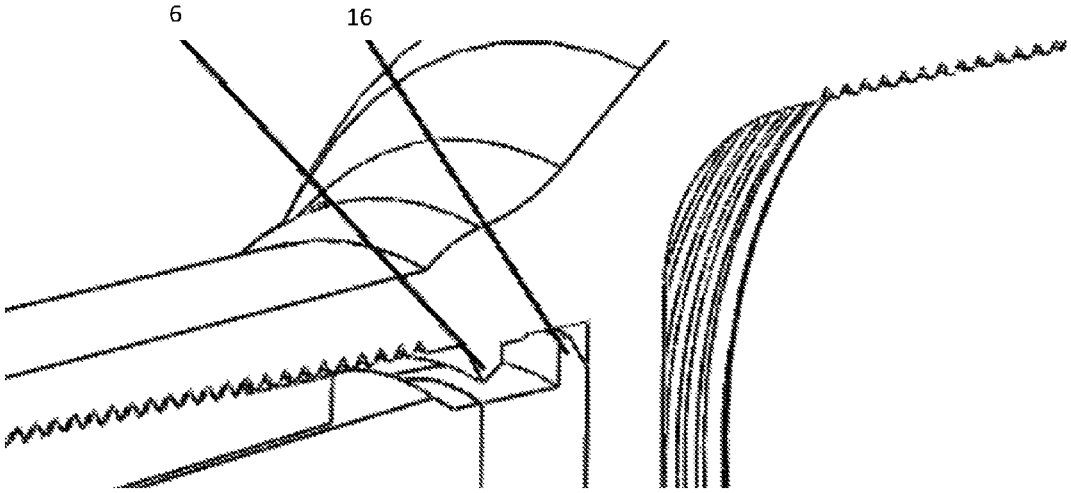

Barrel coupling for firearms comprising muzzle adapter 1 and clamping mechanism 2. The muzzle adapter 1 has a main casing with the internal wall 3 with the bullet orifice 4. The main casing, i.e., the adapter, has at least one inner threaded region (i.e. threading) 5 on the internal surface 35, whereby between the said threaded internal surface region 5 and the said wall 3 with a bullet orifice 4, the circular belt (i.e., annular shoulder) exists 6, and the said circular belt being partially splayed 26 one-way using an eccentric grooving 7, and at the other end on the external surface of the adapter main casings there is an outer threading region 8 for coupling of the muzzle accessories. The clamping mechanism consists of a separator 9 and a sleeve 10. The separator 9 comprises a casing with a plurality of cam sockets 11 and a plurality of elongated L-shaped 29 cams 12 insertable in the said sockets with the longer part 31 of the cam 12 shaped to match the longer part 33 of the socket 11, and with the shorter part 32 of the cam 12 shaped to match the shorter part 34 of the socket 11, wherein each cam has an inner surface 37 and an outer surface 36, and whereby the inner surface 37 of the longer part 31 of the cam 12 comprises notches 13. The end of separator casing 9 which touches the above-mentioned wall 3 with the bullet orifice 4 of the adapter main casing 1 has a wall 14 with the orifice for the bullet 15 and a salient circular belt 16 on the external diameter.

The clamping sleeve 10 comprises a cylindrical casing 38 with an internal surface of frustoconical shape 39 and a threaded region 17 on the external surface of the clamping sleeve 10.

Besides, on the external surface of the adapter main casing there are additional edges for the spanner 18 located on the barrel adapter.

Besides, there is at least one milled groove 19 for interaction with the firearms sighting device at one of the ends of the sleeve 10.

Besides, on the unthreaded external surface of the sleeve 10, there are additional edges for the spanner 20 located on the clamping sleeve 10.

Besides, there is a flange 21 for coupling with the one of the muzzle accessories parts at one of the ends of the sleeve 10.

The barrel coupling for firearms is assembled as follows:

First the separator 9 is assembled. For this, clamping cams 12 with notches 13 are inserted into the sockets 11 of the separator.

Then, the separator 9, with the cams 12 are inserted inside the adapter main casing 1, so that the salient circular belt 16 of the separator casing passes the partially splayed one-way 26 annular shoulder 6 of the adapter main casing 1 through the eccentric grooving 7.

Then, the clamping sleeve is screwed by an outer threaded region 17 on its external surface into the adapter main casing 1 through internal threading region 5 so that the sleeve 10 covers the cams 12 located in the separator casing.

To attach the muzzle accessory to the firearms, the muzzle accessory is secured at one of the ends of the barrel coupling, and the other end of the barrel coupling is mounted to the barrel of a firearm.

Thus, due to offered engineering solution, the possibility to mount the muzzle accessories to the barrels without any special preparation is achieved. At the same time, a new barrel coupling for the firearms is more reliable and more durable, besides, it is comfortable and easy to install and remove.

The invention claimed is:

1. A barrel coupling for firearms, comprising: a barrel adapter and a clamping mechanism; the barrel adapter comprises an inner threaded region and a wall with a bullet orifice; between the at inner threaded region of the barrel adapter and the wall with the bullet orifice, there is an annular shoulder partially splayed on one side; the clamping mechanism comprises a separator and a clamping sleeve; the separator has two ends, one of which is located edge-to-edge with the wall with the bullet orifice of the barrel adapter; the separator comprises at least two cams that are separate from each other, and the at least two cams are removably mounted in corresponding cam sockets of the separator; each of the at least two cams is L-shaped having a longer part and a shorter part; each of the cam sockets have a shorter part and a longer part; the longer part of each of the cam sockets correspond in shape to the longer part of the L-shaped at least two cams; the L-shaped at least two cams have an inner and an outer surface; the inner surface of the longer part of the L-shaped at least two cams have one or more notches; the end of the separator, which is located edge-to-edge with the wall with the bullet orifice of the barrel adapter, is formed with a salient circular belt on an outer diameter of the separator; the clamping sleeve of the clamping mechanism has a cylindrical casing with an internal surface of frustoconical shape; and the cylindrical casing of the clamping sleeve has an outer threaded region.

2. The barrel coupling for firearms of claim 1, further comprising a second internal threaded region located on an end of the wall with the bullet orifice opposite the annular shoulder.

3. The barrel coupling for firearms of claim 1, wherein the wall with the bullet orifice is located at an end of the barrel adapter opposite the firearm.

4. The barrel coupling for firearms of claim 1, further comprising an external threaded region located on an end of the wall with the bullet orifice opposite the annular shoulder.

5. The barrel coupling for firearms of claim 1, wherein the wall with the bullet orifice is located within the barrel adapter and the wall divides an interior space of the barrel adapter into two parts.

6. The barrel coupling for firearms of claim 1, wherein the separator has more than two cam sockets for a corresponding number of L-shaped cams.

7. The barrel coupling for firearms of claim 1, wherein the sleeve of the clamping mechanism has one end and the one end of the sleeve has at least one milled groove for interaction with a sighting device.

8. The barrel coupling for firearms of claim 1, wherein the sleeve of the clamping mechanism has an end comprising a flange.

9. The barrel coupling for firearms of claim 1, wherein the annular shoulder is partially splayed on one side using an eccentric grooving.

* * * * *